US006940470B2

(12) United States Patent
Nesic et al.

(10) Patent No.: US 6,940,470 B2
(45) Date of Patent: Sep. 6, 2005

(54) DIPOLE FEED ARRANGEMENT FOR CORNER REFLECTOR ANTENNA

(75) Inventors: Aleksandar Nesic, Belgrade (YU); Veselin Brankovic, Esslingen (DE); Dragan Krupezevic, Stuttgart (DE); Mohamed Ratni, Esslingen (DE)

(73) Assignee: Sony International (Europe) GmbH, Berlin (DE)

( * ) Notice: Subject to any disclaimer, the term of this patent is extended or adjusted under 35 U.S.C. 154(b) by 85 days.

(21) Appl. No.: 10/381,866

(22) PCT Filed: Jul. 31, 2001

(86) PCT No.: PCT/EP01/08865

§ 371 (c)(1),
(2), (4) Date: Mar. 28, 2003

(87) PCT Pub. No.: WO02/27866

PCT Pub. Date: Apr. 4, 2002

(65) Prior Publication Data

US 2004/0021613 A1 Feb. 5, 2004

(30) Foreign Application Priority Data

Sep. 29, 2000 (EP) ..... 00121454

(51) Int. Cl.[7] ..... H01Q 9/28
(52) U.S. Cl. ..... 343/895
(58) Field of Search ..... 343/795, 834, 343/813, 815, 817, 700 MS

(56) References Cited

U.S. PATENT DOCUMENTS 2,720,590 A * 10/1955 Nail et al. ..... 343/818
5,638,081 A * 6/1997 MacDonald et al. ..... 343/818
5,708,446 A 1/1998 Laramie ..... 343/815

FOREIGN PATENT DOCUMENTS

JP 08102612 8/1996
JP 09162637 10/1997

* cited by examiner

*Primary Examiner*—Wilson Lee
*Assistant Examiner*—Ephrem Alemu
(74) *Attorney, Agent, or Firm*—Frommer Lawrence & Haug LLP; William S. Frommer

(57) ABSTRACT

An antenna device, comprising a dielectric substrate board (10), dipole means (16) formed on the substrate board (10), and reflector member (48, 70, 72) having first and second reflective surfaces which are aparallel to each other define a first angle between each other. A positional relationship between the substrate board (10) and the reflector member (48, 70, 72) is such that the substrate board (10) and a vertex of the first angle ($\alpha$) substantially lie in the same plane and the first and second reflective surfaces lie on opposite sides of the plane, a second angle defined between the substrate board (10) and the first reflective surface being different from zero each. In this way, an antenna device suitable for use in a broad variety of applications is provided which allows easy modification of its antenna characteristics by adjusting the angle between the reflective surfaces and/or the angular position of the reflector member (48, 70, 72) with respect to the substrate board (10).

22 Claims, 13 Drawing Sheets

Fig. 1

DIPOLE FEED ARRANGEMENT FOR CORNER REFLECTOR ANTENNA

Figure 1:
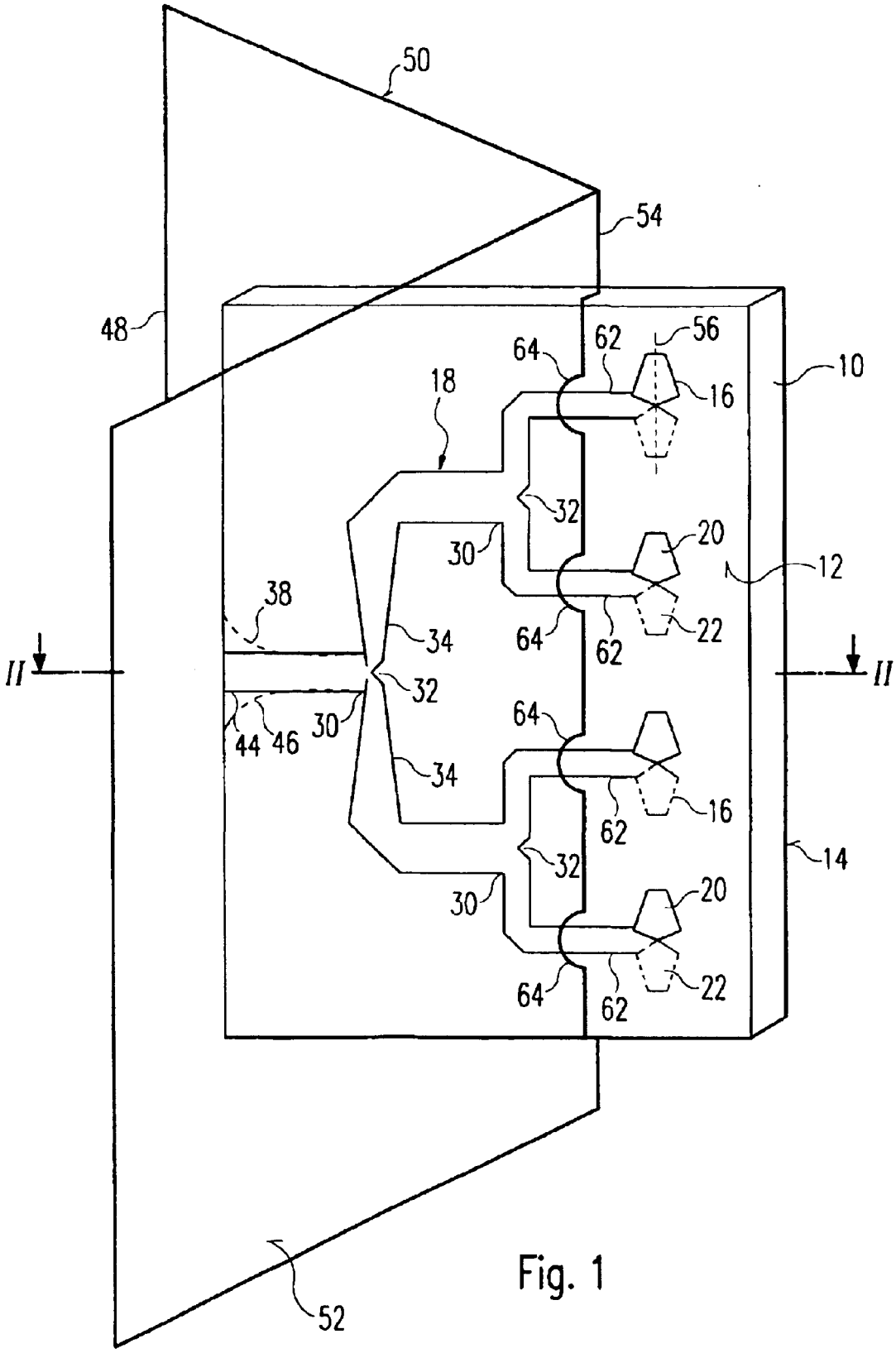

The present invention relates to an antenna device, comprising a dielectric substrate board, dipole means formed on said substrate board, and reflector means having first and second reflective surfaces which are aparallel to each other and define a first angle between each other.

Such an antenna device is known e.g. from U.S. Pat. No. 5,708,446. The antenna device known from this document comprises a right-angle corner reflector having two orthogonal reflective plate members. A dielectric substrate board having a plurality of dipole elements printed thereon is arranged in parallel to and spaced from a first one of the reflective plate members. The substrate board is secured to the first reflective plate member via a spacer member of a low dielectric constant. The described antenna is not suited for broadband application and does not offer specific radiation patterns.

Another antenna device is known from JP 09-162637. The antenna device described in this document comprises a middle plate with radiation elements and a reflex angle corner reflector consisting of two reflecting planes extending in an angle from the middle plate comprising the radiation elements. However, the structure of the described antenna is quite complex since the reflex angle corner reflector consists of different separate elements, i.e. separate reflector planes so that the manufacturing costs are high. Further, the feeding network and the shape of the radiation element of the described antenna are not adapted for broadband applications.

The object of the present invention is therefore to provide an antenna device with a simple structure which can be manufactured in a simple and cost effective way. Further, the new antenna structure should be operable in a large variety of different applications and should be suited for broadband operation.

To achieve the above object, the present invention provides an antenna device, comprising:

a dielectric substrate board, dipole means formed on said substrate board, and reflector means having first and second reflective surfaces which are aparallel to each other define a first angle between each other, and are formed on a single reflector member, whereby a positional relationship between said substrate board and said reflector means is such that said substrate board and a vertex of said first angle substantially lie in a same plane and said first and second reflective surfaces lie on opposite sides of said plane, a second angle defined between said substrate board and said first reflective surface and a third angle defined between said substrate board and said second reflective surface being different from zero each.

Particularly the construction of the reflector means with a first and a second reflective surfaces formed on a single reflector member enables a very simple structure of the new and inventive antenna device which can be manufactured at low cost. Particularly, the shape and the relationship of the first and the second reflective surfaces in respect to each other can be modified very easily by bending and/or curving the reflector means in an appropriate way in order to match the requirements for the specifically wanted application.

The antenna device according to the present invention thus offers a high degree of freedom in modifying the antenna characteristics and specifically the antenna pattern. A first possibility to modify the antenna characteristics is to adjust the angular relationship between the first and second reflective surfaces. It has been shown that by adjusting the first angle (which is the angle formed between the two reflective surfaces) the antenna pattern of the antenna device according to the present invention can be modified. A second possibility is to vary the angular position of the dielectric substrate board with respect to the first and second reflective surfaces. In this way, the ratio of the second angle (which is the angle formed between the first reflective surface and the substrate board) to the third angle (which is the angle formed between the second reflective surface and the substrate board) can be varied, independent of the first angle. It has been shown that this ratio has an impact on the antenna pattern, too. Depending on the particular application, a desired antenna pattern can thus be obtained by suitably adjusting at least one of the angular relationships between the first and second reflective surfaces (i.e. the first angle) and the angular position of the substrate board with respect to the first and second reflective surfaces (i.e. the ratio between the second and third angles). The present invention thus proposes an antenna structure which allows to build a low cost high gain antenna in the elevation plane and 180° degree (wide) pattern in the azimuth plane. The easy way of modifying the antenna characteristics enables the antenna device according to the present invention to be used in a broad variety of applications. Particularly, the antenna device according to the present invention is extremely broadband and offers around 40% of the bandwidth around the center frequency.

In the antenna device according to the present invention, the second and third angles may be equal to each other or different from each other. Preferably, they may range from 10 degrees to 170 degrees each. Depending on the desired application, the first and second reflective surfaces of the reflector means can either be plane surfaces or curved surfaces. Hereby, it may be advantageous if the reflector member is made from a plate member which is bent essentially into a V-shape having a fold line at said vertex of said first angle. Hereby, the vertex lies on the sharp edge of the V-shaped plate member. The reflective surfaces can hereby be plane or curved surfaces. Alternatively, the reflector means may be bent into a curved shape with no sharp edges, as e.g. a semi-elliptic or semi-circular shape. In this case, the vertex does not have to be a geometrically distinctive line but may be any appropriate line on the curvature.

In a further alternative, the reflector member may advantageously form a closed ring in its cross-section. Hereby, the closed ring may have a circular shape, an elliptic shape, a rectangular shape or the like. The reflector member forming the closed ring is particularly advantageous for applications in which an omni-directional radiation pattern in the azimuth angle and a high gain pattern in the elevation angle is required. This type of antenna is particularly suited for applications in multi-system base stations (e.g. GSM and UMTS systems may be covered by the same antenna), future software radio base stations, ultra wideband-systems access points and the like. This type of antenna is thus specifically advantageous for the application and use in different geographical areas without a need to specifically re-design the antenna structure for each application. Particularly the wideband or broadband operability of the proposed antenna structure covering 40 to 70% of the center frequency of operation is very advantageous.

Advantageously, the dipole means are arranged outside of the reflector means, whereby first dipole means are located outside a first vertex and second dipole means are located outside a second vertex. The inside is here the inner part of the closed ring of the reflector member, the outer side of which entirely reflects radiation from the dipole means in every direction. Hereby, the first and the second dipole means may be located outside a respective opposite side of the reflector means, whereby third and fourth dipole means are located outside the reflector means in a plane perpendicular to the plane of the first and the second dipole means. In other words, in a cross-sectional view of the proposed antenna, the four dipole means are located at 90° to each other around the closed ring of the reflector member. E.g., if the closed ring has a rectangular or quadratic shape, the dipole means can be located along each edge.

Further advantageously, the dipole means are arranged in a distance between 0.1 and 0.4 λ from the reflector means, λ being the wavelength of the center frequency of operation of the antenna device. It is particularly advantageous if the dipole means are arranged in a distance of 0.25λ from the reflector means.

When the reflector member is formed with a slot substantially at said vertex of said first angle, the substrate board may be inserted so as to extend therethrough. In this way, the reflector member can be easily secured to the substrate board. Advantageously, the width of said slot substantially corresponds to the thickness of said substrate board.

Metal strip means for supplying signals to and from said dipole means may be formed on said substrate board. It may happen that said metal strip means comprise at least one strip segment which crosses said reflector member. In order to avoid disturbation of the signals being transmitted over the strip segment by the reflector member, said slot of said reflector member advantageously has an enlarged slot portion where said strip segment crosses said reflector member. The enlarged slot portion preferably has a rounded contour.

The dipole means may comprise at least one dipole element having first and second dipole portions for radiating and receiving electromagnetic signals, said first dipole portion being formed on a first board face of said substrate board and said second dipole portion being formed on a second board face of said substrate board opposite to said first board face. The metal strip means may comprise at least one strip segment crossing said reflector member on each of said first and second board faces. Then, said slot of said reflector member advantageously has an enlarged slot portion in allocation to each strip segment.

Further advantageously, the reflector means is forming the support of said antenna device.

The present invention further provides a group of antenna devices of the kind described above, wherein each antenna device of said group differs from every other antenna device of said group in at least one of said first angle and the ratio of said second angle to said third angle. Alternatively, the group of antenna devices can comprise only identical antenna devices of the kind described above.

Figure 2:
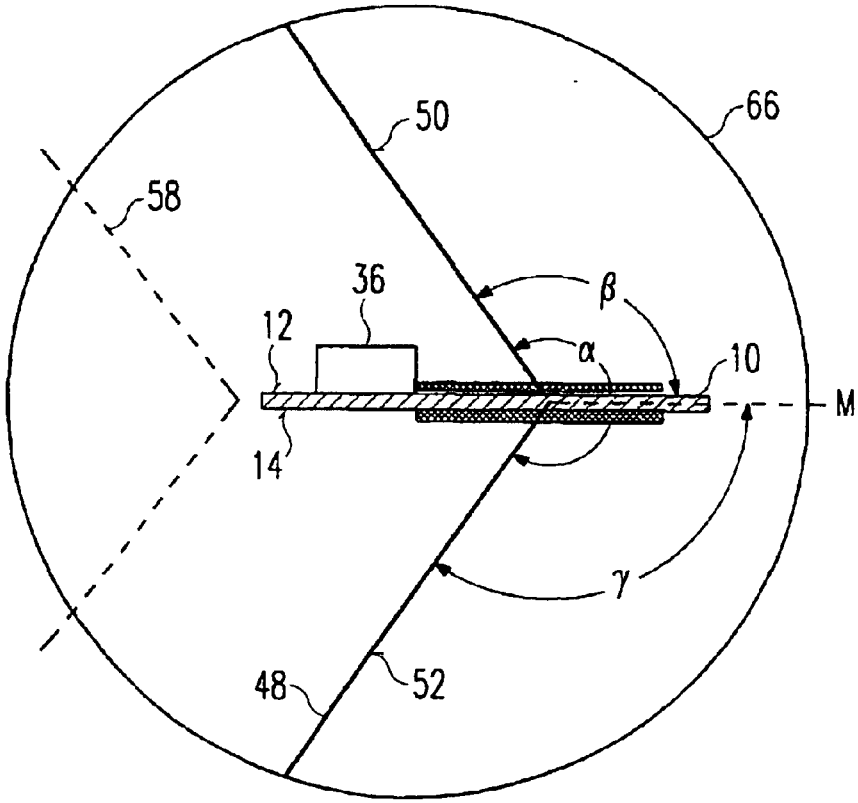
Figure 3:
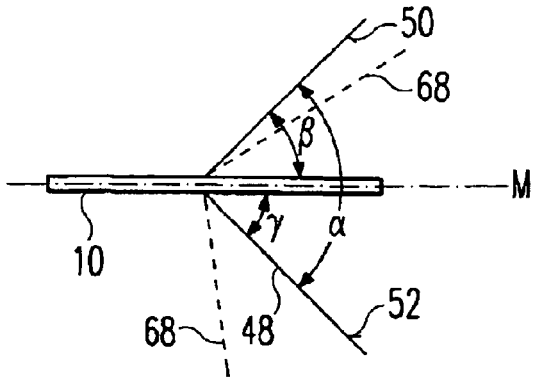
Figure 4:
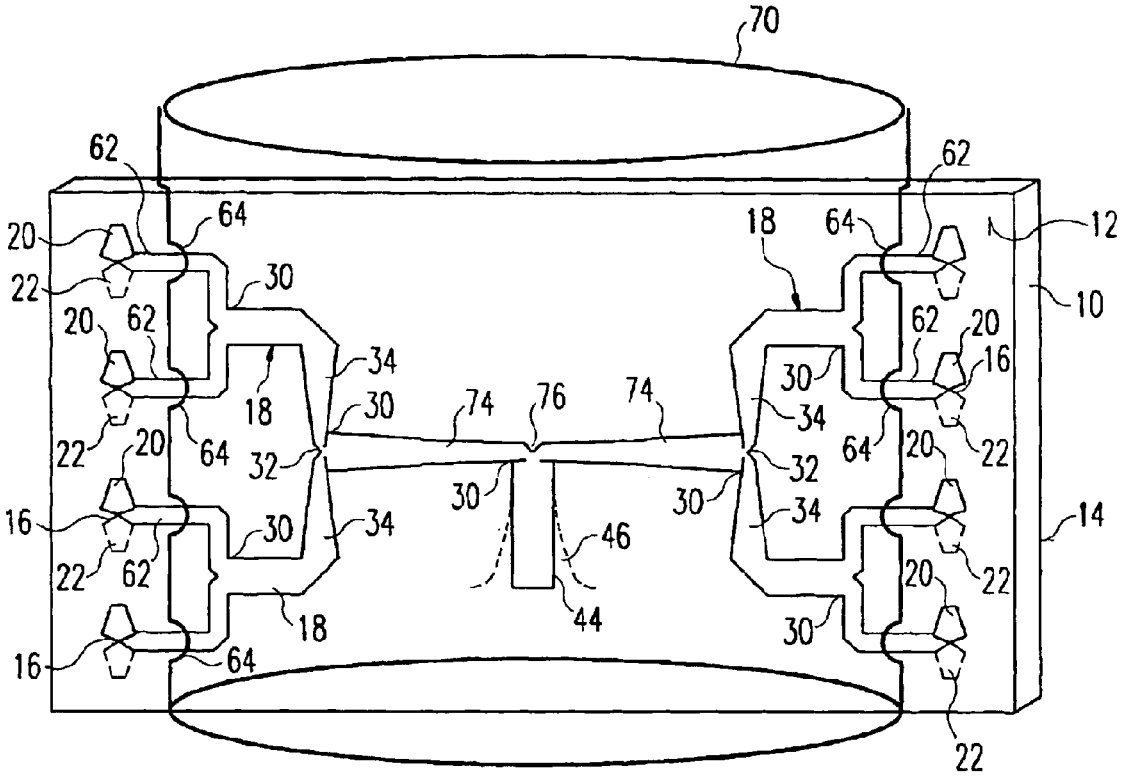
Figure 5:
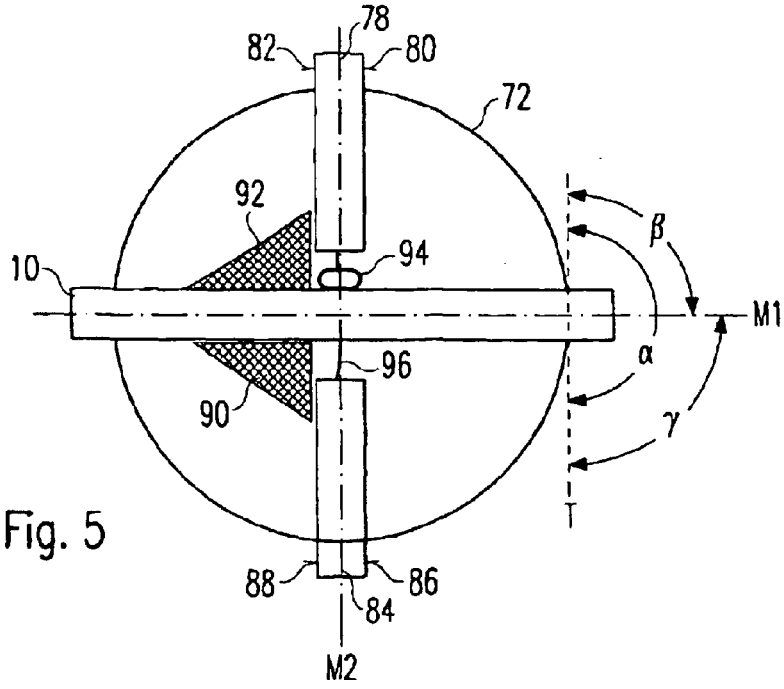
Figure 6:
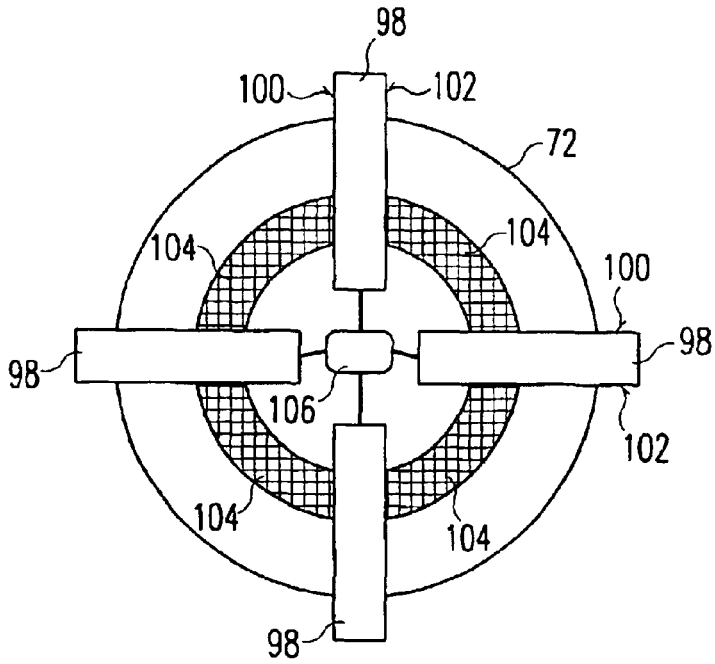
Figure 7:
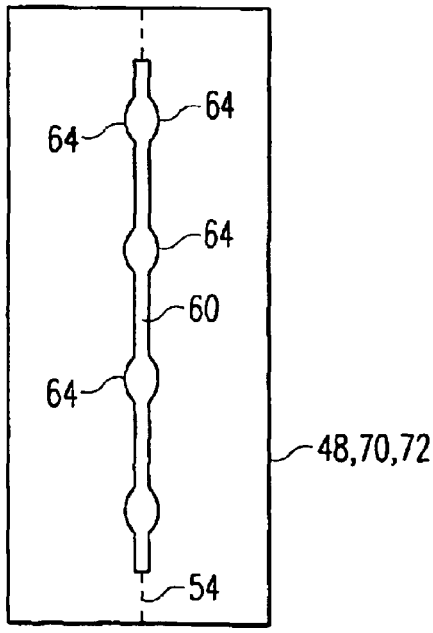
Figure 8:
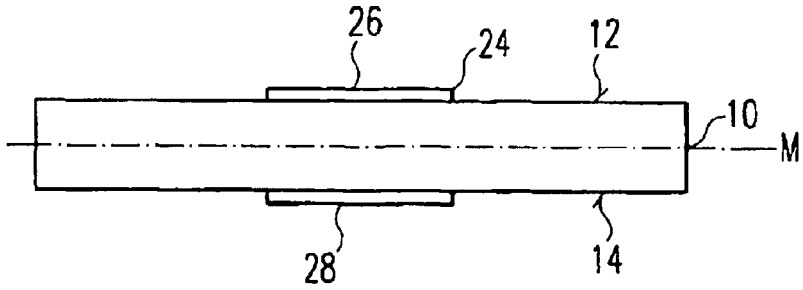
Figure 9:
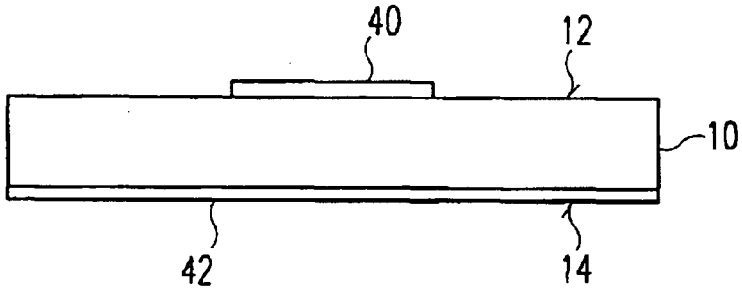
Figure 10:
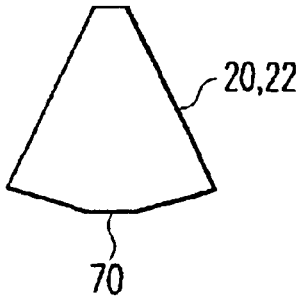
Figure 13:
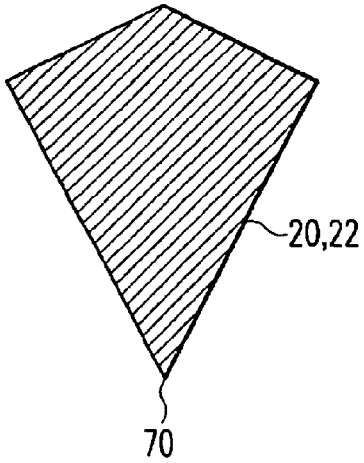
Figure 14:
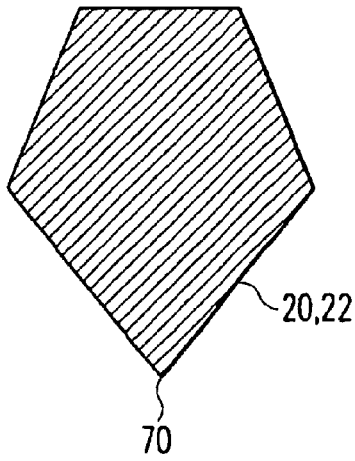
Figure 15:
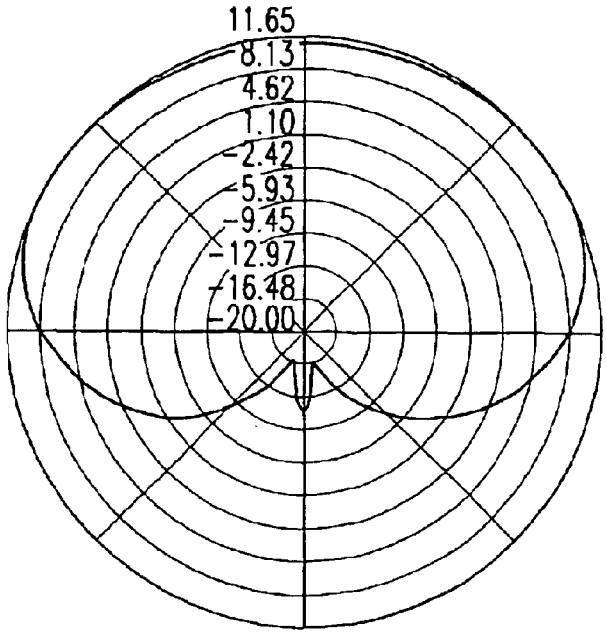
Figure 16:
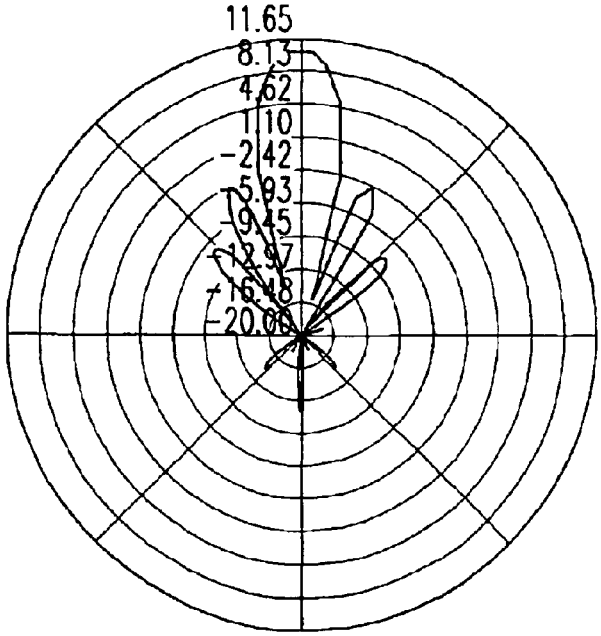
Figure 17:
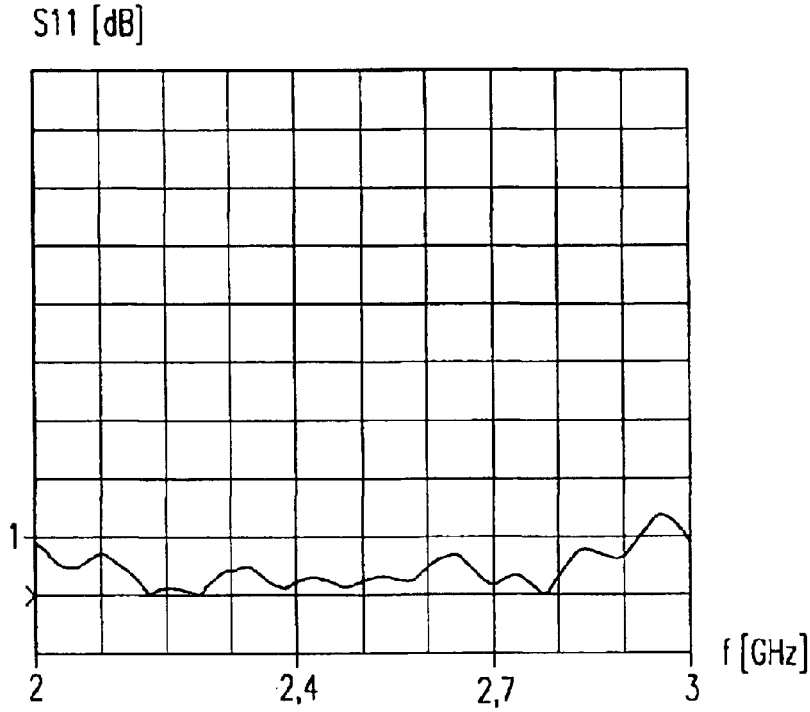
Figure 18:
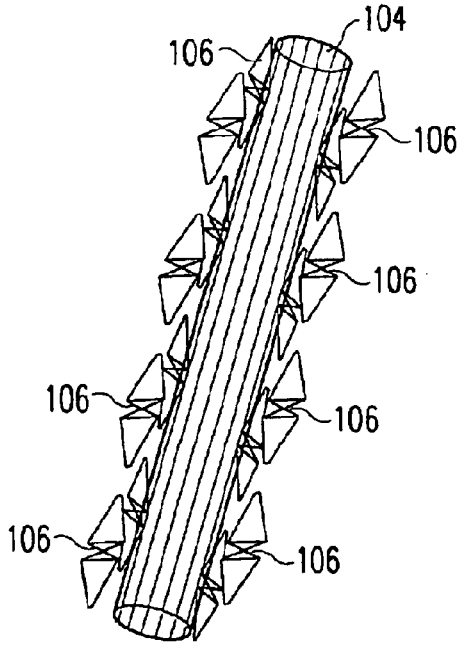
Figure 19:
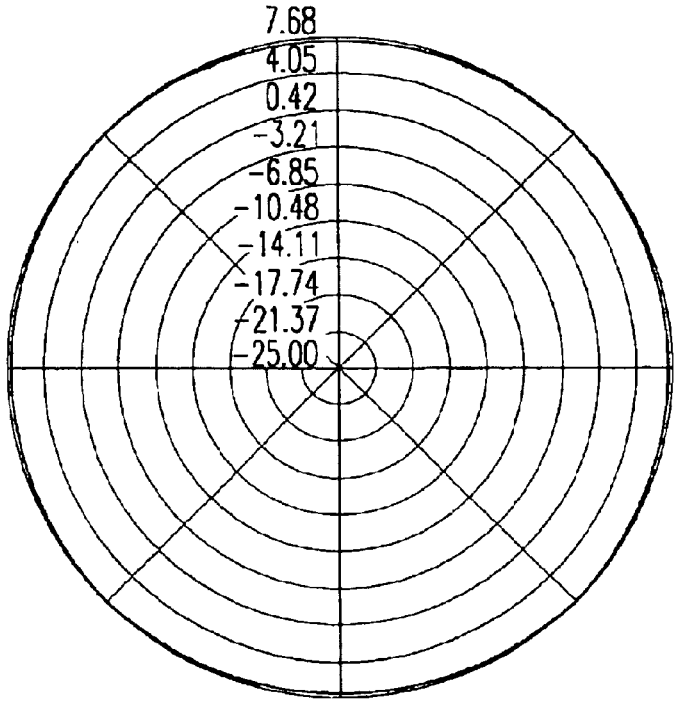
Figure 20:
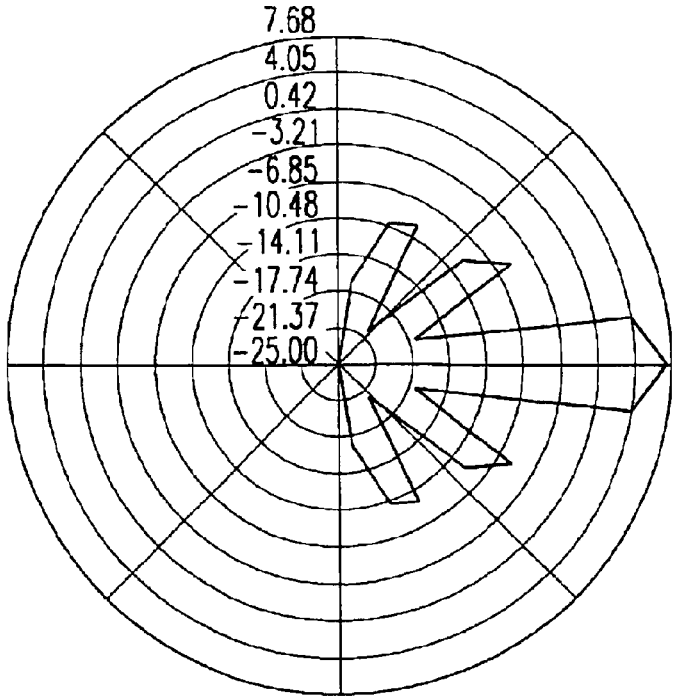
Figure 21:
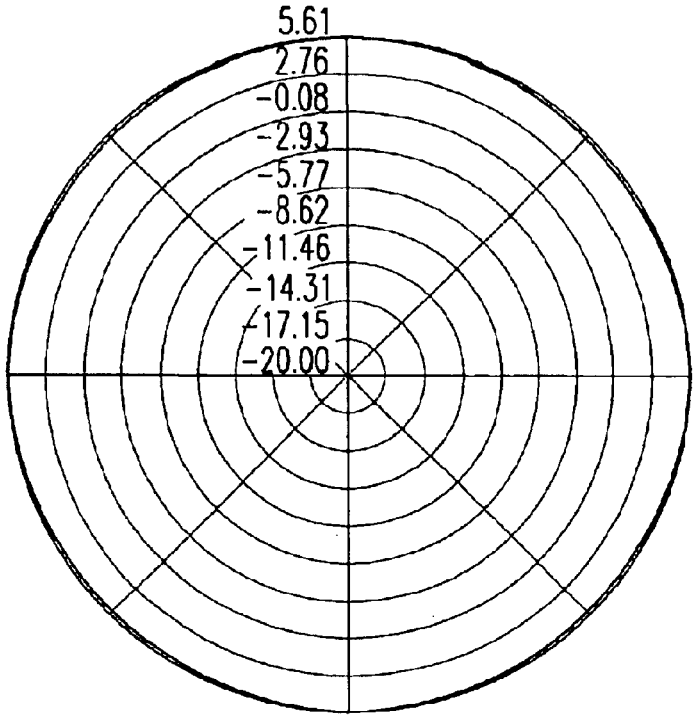
Figure 22:
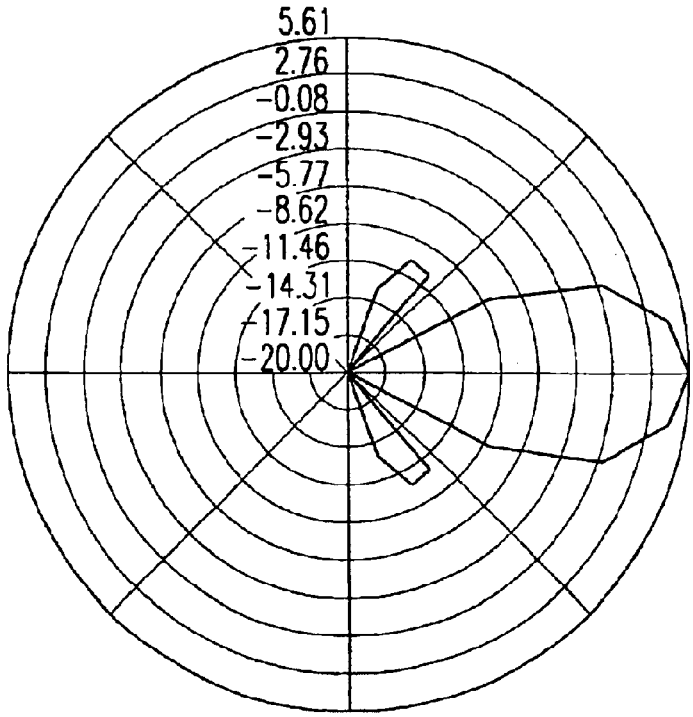
Figure 23:
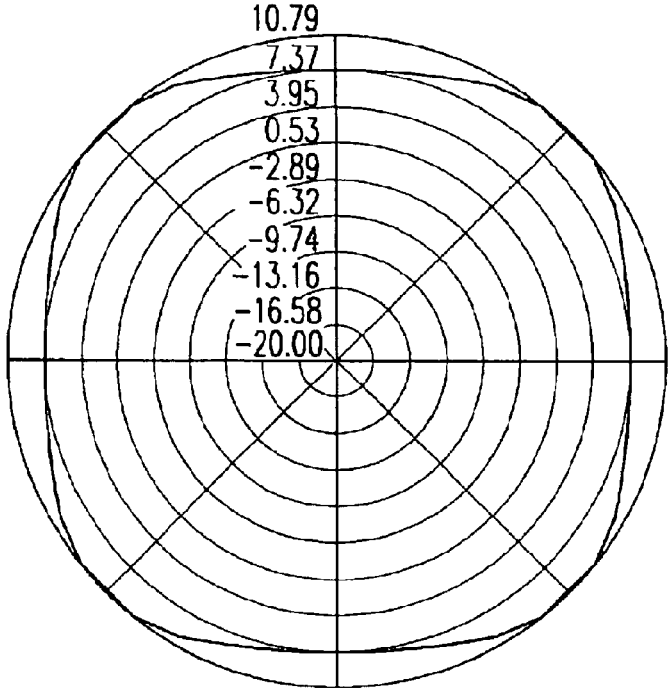
Figure 24:
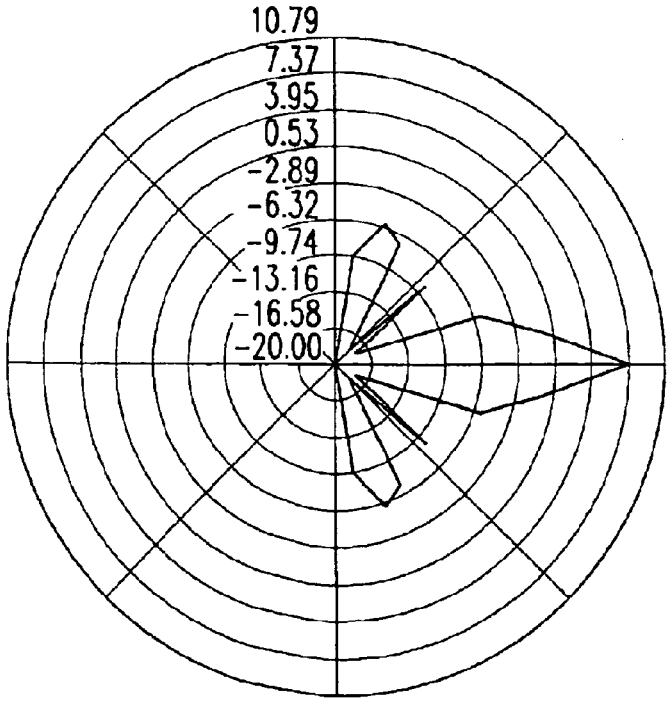
Figure 25:
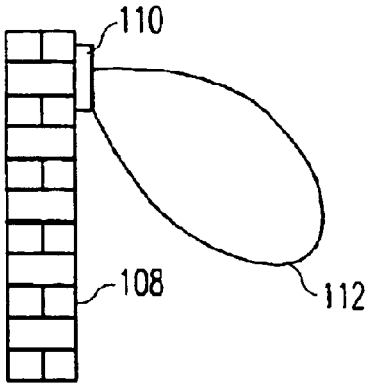
Figure 26:
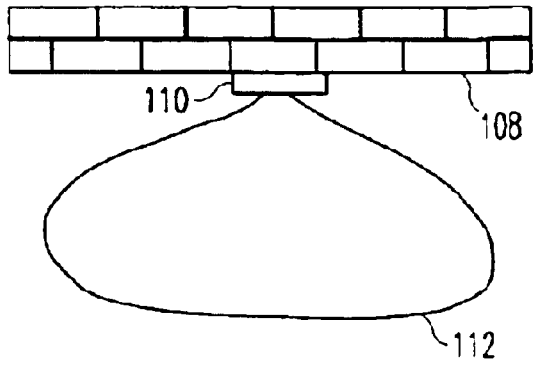
Figure 27:
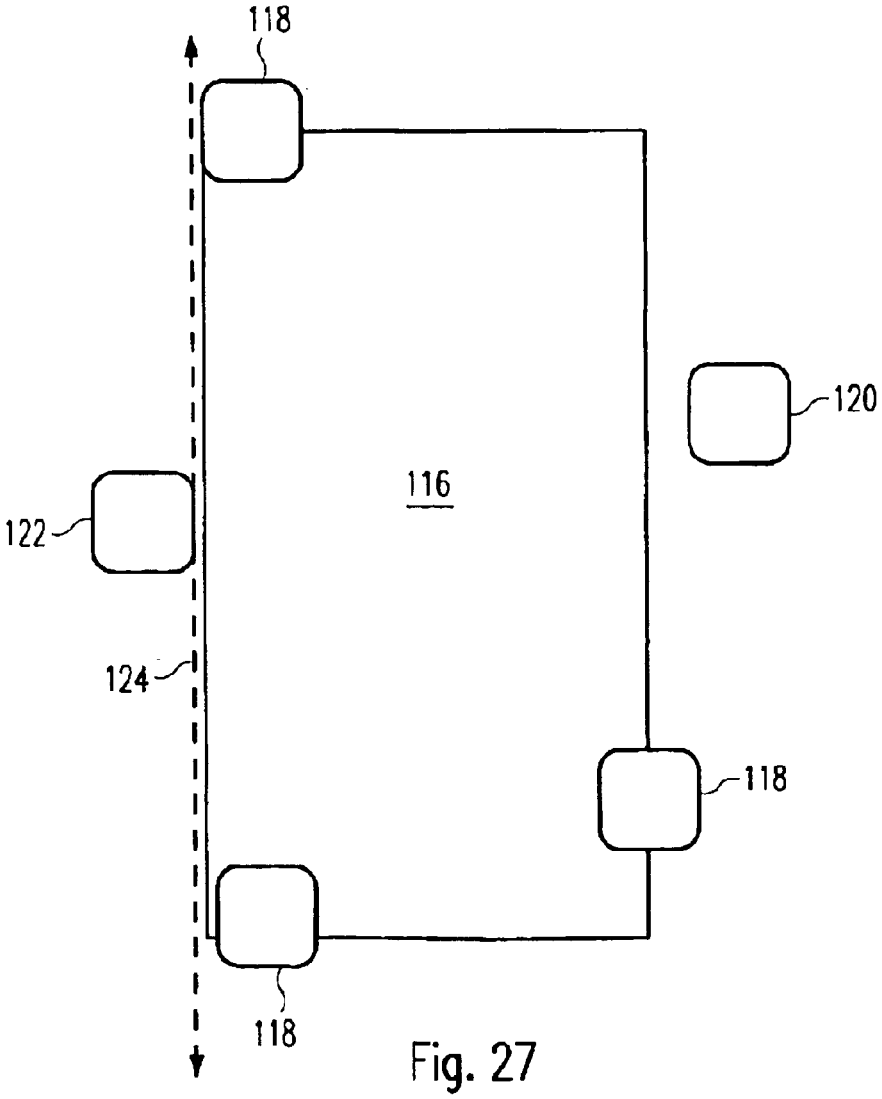
Figure 28:
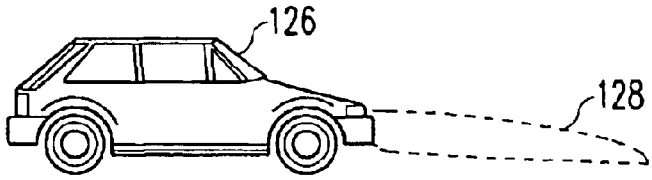
Figure 29:
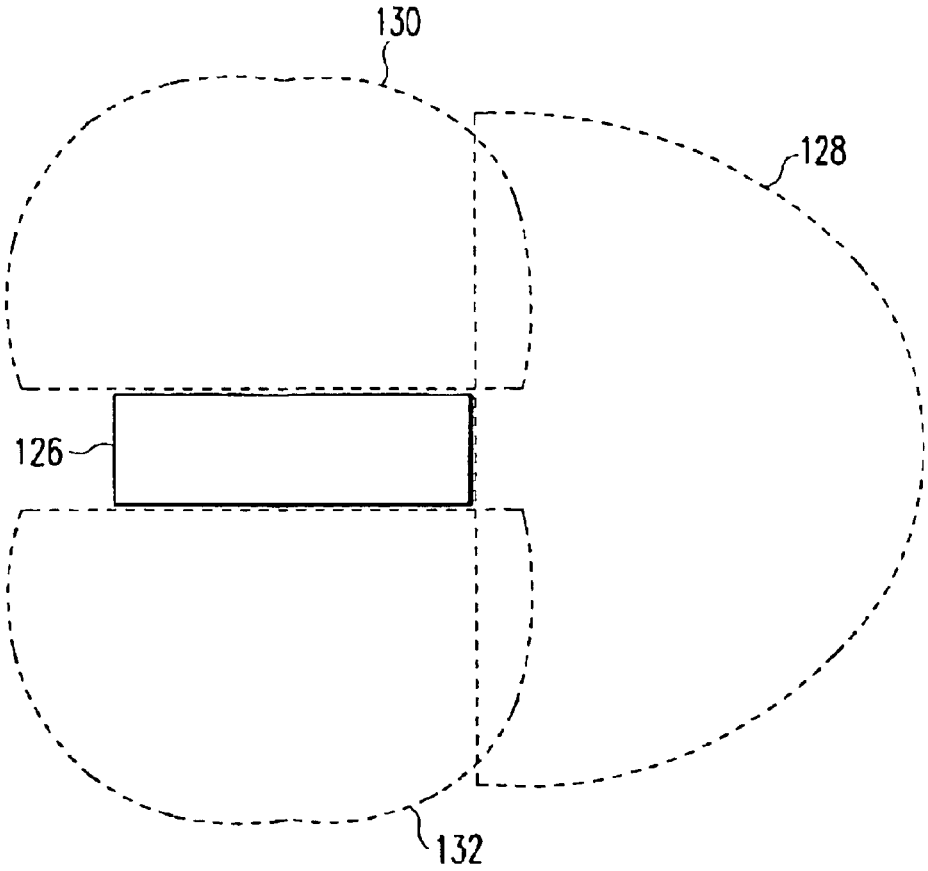

In the following, the present invention will be explained in more detail in relation to the accompanying drawings in which:

FIG. 1 schematically shows a perspective view of a first embodiment of an antenna device according to the present invention, FIG. 2 shows a sectional view of the antenna device of FIG. 1 taken along a line II—II in FIG. 1, FIG. 3 shows another sectional view of a modified antenna device similar to the one shown in FIGS. 1 and 2, FIG. 4 schematically shows a perspective view of a second embodiment of an antenna device according to the present invention, FIG. 5 shows a sectional view of a modified antenna device similar to the one shown in FIG. 4, FIG. 6 shows a sectional view of a modified antenna device similar to the one shown in FIGS. 4 and 5, FIG. 7 shows a part of a reflector means of an antenna device according to the present invention comprising a slot along a vertex line, FIG. 8 shows a cross section of a balanced microstrip line used in the antenna devices of FIGS. 1 to 6, FIG. 9 shows a cross section of a microstrip line used in the antenna devices of FIGS. 1 to 6, FIG. 10 shows a dipole portion of a dipole element used in the antenna devices of FIGS. 1 to 6, FIGS. 11 to 14 show variations of the dipole portion of FIG. 10, FIG. 15 shows a simulated azimuth pattern of the antenna device shown in FIGS. 1 and 2, FIG. 16 shows a simulated elevational pattern of the antenna device shown in FIGS. 1 and 2, FIG. 17 shows a measured diagram of the standing wave ratio (SWR) of the antenna device shown in FIGS. 1 and 2, FIG. 18 shows a simulated antenna device similar to the antenna devices shown in FIGS. 5 and 6, FIG. 19 shows a simulated azimuth pattern of the antenna shown in FIG. 18 at a center frequency of 2.4. GHz, FIG. 20 shows a simulated elevational pattern of the antenna device shown in FIG. 18 at a center frequency of 2.4 GHz, FIG. 21 shows a simulated azimuth pattern of the antenna device shown in FIG. 18 at a center frequency of 1.5 GHz, FIG. 22 shows a simulated elevational pattern of the antenna device shown in FIG. 18 at a center frequency of 1.5 GHz, FIG. 23 shows a simulated azimuth pattern of the antenna shown in FIG. 18 at a center frequency of 3.4 GHz, FIG. 24 shows a simulated elevational pattern of the antenna shown in FIG. 18 at a center frequency of 3.4 GHz, FIG. 25 shows a schematic side view of a first application example of an antenna device according to the present invention, FIG. 26 shows a top view of the application example of FIG. 26, FIG. 27 schematically shows a second exemplary scenario for applying the antenna device according to the present invention, FIG. 28 shows a side view of a third application example of the antenna device according to the present invention, and FIG. 29 shows a top view of the application scenario illustrated in FIG. 29.

The antenna device illustrated in FIGS. 1 and 2 comprises a dielectric substrate board 10 having a first (front) board face 12 and a second (back) board face 14. An array of dipole elements 16 for radiating and receiving electromagnetic signals is formed on the substrate board 10. Also, a feeding network 18 generally designated by 18 is formed on the substrate board 10 and serves for supplying signals to and from the dipole elements 16. Each dipole element 16 has a first dipole portion 20 printed on the front board face 12 of the substrate board 10 and a second dipole portion 22 (illustrated in dashed lines in FIG. 1) printed on the back board face 14 of the substrate board 10. The feeding network 18 is designed as a balanced microstrip feeding network which is formed of metal strip lines printed on the front and back board faces 12, 14 of the substrate board 10.

To explain the term balanced microstrip feeding network, reference is made to FIG. 8. A balanced microstrip line 24 formed on the substrate board 10 is shown in cross section. The balanced microstrip line 24 comprises a first metal strip line 26 printed on the front board face 12 of the substrate board 10 and a second metal strip line 28 printed on the back board face 14 of the substrate board 10. The metal strip lines 26, 28 are arranged in parallel to each other and symmetrically with respect to a middle plane M of the substrate board 10. Balanced microstrip feeding network means the the feeding network 18 is comprised of balanced microstrip lines like the balanced microstrip line 24 shown in FIG. 8.

Specifically, the feeding network 18 is designed with a tree structure having a plurality of T junctions 30 serving for branching out the feeding network 18 to the dipole elements 26. Each T junction 30 has a compensation gap 32 to compensate for the influence of the junction discontinuity. Furthermore, the feeding network 18 comprises tapered impedance transformers 34 serving for impedance matching. The T junctions 30 and the impedance transformers 34 have a balanced microstrip structure, too.

For more details on the feeding network 18 and its connection to the dipole elements 16 it is referred to U.S. Pat. No. 6,037,911 which is incorporated herein by reference. This document shows a similar tree-shaped feeding network designed with a balanced microstrip structure.

As illustrated in FIG. 2, a front-end device 36 can be mounted on the substrate board 10. In order to integrate the antenna device with the front-end device 36 on the same substrate, a suitable transition from the balanced microstrip feeding network 18 to the transmission line technology of the front-end device 36 has to be provided on the substrate board 10. In FIG. 1, a balun 38 provides for a transition from the feeding network 18 to an unbalanced microstrip structure which is assumed to be used in the front-end device 36 for signal transmission. In order to explain an unbalanced microstrip structure, reference is made to FIG. 9. There, a metal strip line 40 is printed on one of the board faces of the substrate board 10, here the front board face 12. A metal backing 42 is printed on the other board face (here 14) of the substrate board 10. The backing 42 is much broader than the strip line 40.

To provide for the transition between the unbalanced microstrip structure and the balanced microstrip structure, the balun 38 comprises a metal strip line 44 printed on one of the board faces of the substrate board 10, here the front board face 12, and an exponentially widening metal backing segment 46 (illustrated in dashed lines in FIG. 1) printed on the other board face (here 14) of the substrate board 10.

It is to be undestood that in case of a waveguide technology being used in the front-end device 36, the balun 38 will be replaced by a suitable waveguide to balanced microstrip transition element. In case of a coplanar line technology or a coaxial line technology being used in the front-end device 36, a coplanar to balanced microstrip or a coaxial to balanced microstrip transition element will be provided instead of the balun 38.

A reflector member 48 made of metal or of a metallized plastics material is supported on the substrate board 10. The reflector member 48 has two plane reflective surfaces 50, 52 situated on opposite sides of the substrate board 10 with respect to the board's middle plane M. The reflective surfaces 50, 52 are angled with respect to each other and with respect to the substrate board 10 and intersect at the level of the substrate board 10. Their position with respect to the dipole elements 16 is such that a line of intersection 54 (cf. FIG. 1) of the reflective surfaces 50, 52 is substantially parallel to the direction of a dipole axis 56 of each of the dipole elements 16. As shown in FIG. 2, a first angle defined between the two reflective surfaces 50, 52 is designated with $\alpha$, a second angle defined between the reflective surface 50 and the substrate board 10 is designated with $\beta$ and a third angle defined between the reflective surface 52 and the substrate board 10 is designated with $\gamma$. The angles $\alpha$, $\beta$,$\gamma$ are all different from zero. It can be clearly seen that the vertex of the first angle $\alpha$ substantially lies in the middle plane M of the substrate board 10.

In the embodiment shown in FIGS. 1 and 2, the reflector member 48 is made in one piece from a single plate member by bending the plate member along the intersection line 54 into a V shape. Bending of the plate member is preferably carried out so as to result in a rather sharp fold edge, as shown in FIG. 1, although it is possible for the bending process to give a rounded fold region after bending. A corresponding embodiment with curved or rounded reflection means are shown in FIGS. 4, 5 and 6 explained further below. It is principally envisageable to arrange the V shaped reflector member 48 behind the substrate board 10 with respect to the main radiation direction of the dipole elements 16, as indicated in FIG. 2 by dashed lines 58, and to secure the reflector member 48 to the substrate board by suitable fastening means. However, the distance from the dipole elements 16 to the reflective surfaces 50, 52 would be relatively great in this case. It is advantageous to arrange the dipole means 16, i.e. their longitudinal axis 56 as indicated in FIG. 1, in a distance between 0.1 and 0.4$\lambda$ from the vertex, i.e. the fold line 54 in the example shown in FIG. 1. $\lambda$ is the wavelength of the center frequency of the operation of the antenna device. Particularly advantageously, the dipole means 16 are arranged in a distance of 0.25$\lambda$ from the reflector means 48. In order to enable the reflective surfaces 50, 52 to be arranged more close to the dipole elements 16, the reflector member 48 is formed with an elongated slot 60 extending along the intersection or fold line 54, as can be seen in FIG. 7. The slot 60 allows the reflector member 48 to be put over the substrate board 10 by inserting the latter into the slot 60. The width of the slot 60 substantially corresponds to the thickness of the substrate board 10. The slot 60 can be open at one end thereof toward the periphery of the reflector member 48. Alternatively, it can be formed entirely within the periphery of the reflector member 48, as is the case in the embodiment illustrated in FIG. 7. Conveniently, the slot 60 is formed in the reflector member 48 before bending thereof, e.g. by punching.

As can be seen in FIG. 1, insertion of the substrate board 10 into the slot 60 makes several strip line segments 62 of the feeding network 18 on both board faces 12, 14 of the substrate board 10 to cross the reflector member 48. In order to avoid discontinuities in the balanced microstrip lines including these strip line segments 62, the slot 60 is formed with a lokal slot enlargement 64 wherever one of the strip line segments 62 extends through the reflector member 48 (see FIGS. 1 and 7). In this way, a "tunnel" is created for each strip line segment 62. The slot enlargements 64 are preferably rounded, e.g. part-circular or part-elliptic. Their size and shape are designed so as eliminate any disturbances that might be imposed on the signals travelling along the strip line segments 62 by the material of the reflector member 48.

An optional radom 66 may be provided to protect the antenna device. From a practical point of view, the radom diameter may be about 12 cm in case of a 2,4 GHz application and 1 cm or less in case of a 60 GHz application.

It has been shown that in the antenna device according to the present invention the antenna pattern and specifically the radiation angle in azimuth, i.e. in a plane parallel to the substrate board 10, can be modified by changing the angles $\alpha$, $\beta$, $\gamma$. Such modification can be easily performed by bending the reflector member 48 to a different angle $\alpha$ and/or arranging the substrate board 10 at a different angular position with respect to the reflector member 48, thus changing the ratio of the second angle β to the third angle γ. In particular, in the antenna device according to the present invention, a wider radiation angle in azimuth can be obtained at a larger value of the angle α and a narrower radiation angle can be obtained at a smaller value of the angle α. Each of the angles β, γ preferably will be chosen within a range from 10° to 170°. In the embodiment of FIGS. 1 and 2, the angles β, γ are substantially equal to each other and are approximately 125° each. FIG. 3 shows a further embodiment in which each of the angles β, γ is smaller than 90° and is approximately 45°. The angles β, γ are not required to be equal; different values can be chosen for them. As an example, dashed lines 68 in FIG. 6 illustrate a case in which the reflective surfaces of the reflector member are arranged asymmetrically with respect to the middle plane M of the substrate board 10.

FIG. 4 shows schematically a perspective view of a further embodiment of an antenna device according to the present invention. The embodiment shown in FIG. 4 comprises a reflector member 70 having a circular shape in its cross section. In the respective view shown in FIG. 4, the reflector means 70 has a cylindrical shape. The reflector member 70 consists either of metal or metallised plastic. In the embodiment shown in FIG. 4, a dielectric substrate board 10 with a first board face 12 and a second board face 14 similar to the one shown in FIG. 1 is provided. The structure of the feeding network 18 and the dipole element 16 of the embodiment shown in FIG. 4 are essentially identical to the one shown in FIG. 1, so that all statements made above in relation to the embodiment of FIG. 1 also apply to the embodiment shown in FIG. 4. The only difference is that the dielectric substrate board 10 extends along a symmetric middle plane of the cylindrical reflector member 70 so that dipole elements 16 are respectively located on opposite sides of the reflector member 70 in order to radiate and receive electromagnetic signals to and from, respectively, opposite directions. The dipole elements 16 on both sides of the reflective member 70 are connected to a common feeding network, i.e. balanced and tapered microstrip lines 74 leading to a common balun 38 forming the transition from the balanced middle strip line feeding network to an unbalanced feeding line consisting of the metal strip line 44 and the exponentially widening metal backing segment 46 printed on the other board phase of the substrate board 10. The corresponding T-junction 30 combining the tapered microstrip lines 74 has a compensation gap 76 to compensate for the influence of the junction discontinuity. Similar as in the embodiment shown in FIG. 1, the substrate port 10 extends through slots 60 on opposite sides of the cylindrical reflector member 70 in the embodiment shown in FIG. 4. The slots 60 of the reflector member 70 also have the shape shown in and explained in relation to FIG. 7. The cylindrical reflector member 70 is made in one piece from a single plate member by bending the plate member into a cylindrical shape. In contrary to the embodiment shown in FIG. 1, the reflector member 70 does not have any sharp folding edge, but a continuous curvature. As can be seen in FIG. 5 which also shows an embodiment of the antenna device with a cylindrical reflector member 72, the vertex of the angle α can hereby be formed by any intersection of a tangential plane T of the cylindrical reflector member 72 and the middle plane M1 of the substrate 10. Since the shape of the reflector member 70 is cylindrical, its cross section is circular as can be seen in FIG. 5 and also in the similar embodiment shown in FIG. 6, whereby the angle α equals 180°, and the angles β and γ equal 90°, respectively.

FIG. 5 shows another embodiment of an antenna device according to the present invention with a circular reflector element 72 similar to the embodiment shown in FIG. 4. However, in the embodiment shown in FIG. 5 additional substrate boards 78 and 84 are provided, which extend perpendicular to the substrate board 10, so that a cross-like shape is achieved. Each dielectric substrate board 78 and 84 has a first board face and a second board face onto which dipole elements 16 for radiating and receiving electromagnetic signals are printed, identical to the dipole elements 16 of the substrate boards 10. Further, both dielectric substrate boards 78 and 84 comprise a feeding network 18 as shown and explained in relation to FIGS. 1 and 4. In the embodiment shown in FIG. 5, the antenna device thus has four sets of dipole elements 16 arranged in angles of 90° in respect to each other, whereby the feeding network 18 of the dielectric substrate board 84 is connected to the corresponding part of the feeding network 18 of the dielectric substrate board 10 by means of a cable or band connection 96, whereas the feeding network 18 of the dielectric substrate board 78 is connected to the corresponding part of the feeding network 18 of the substrate board 10 by means of a functional block 94 which provides a power splitting.

Optionally, support means 92 and 90 can be provided in order to provide mechanical support for the antenna device. The support members 90, 92 preferably consist of non-conductive materials, like plastic. Alternatively, however, the reflector member 70 of FIG. 4 or 72 of FIGS. 5 and 6 is adapted and shaped to form mechanical support for the antenna device, so that no further support elements are necessary.

The embodiment shown in FIG. 6 is very similar to the one shown in FIG. 5, except that four substrate boards 98 are provided, in contrary to the embodiment shown in FIG. 5, in which only three substrate boards are used. In the embodiment shown in FIG. 6, each dielectric substrate board 98 extends in an angle of 90° in respect to its adjacent substrate boards 98. Each substrate board 98 has a first board face 100 and a second board face 102 and comprised dipole elements 16 and a feeding network 18 as shown in and explained in relation to FIG. 1. The connection between the four substrate boards 98 is achieved with a small connecting structure 106 for providing power splitting e.g. by using a chip based broad band power splitter as alternative to a reactive broad band tapered power splittered printed on the main substrate 10 as in the embodiment of FIG. 5. The embodiment shown in FIG. 6 further comprises support elements 104 between the respective substrate boards 98, advantageously consisting of non-conductive material, like plastic.

It is to be understood that the cylindrical shape of the reflector member 70 or 72 of the embodiments shown in FIGS. 4, 5 and 6 is only an example and that other shapes may be used. E.g., the cross section of the ring shaped reflector member 70 may be elliptical, rectangular, hyperbolic, polynomial or the like. In case of a reflector member with a rectangular cross section, the set of dipoles can either be arranged along each corner of the reflector member, or e.g. in the middle of each of the four planes. It should be noted that the reflector member 70, 72 may have in general a closed surface, having the same cross-section along its height. Alternatively, the cross-section may vary along the height.

It is further to be noted that all elements shown in FIG. 4 having the same reference numerals as the corresponding elements in the embodiment of FIG. 1 have the same function and that all explanations in relation to FIG. 1 also apply to the embodiment of FIG. 4. The arrangement of the dipoles 16 and the feeding network 18 is further identically and correspondingly applied in the embodiments of FIGS. 5 and 6. The same is true for the arrangement and the shape of the slot 60, through which the substrate boards 10, 78, 84 and 98 extend. All explanations made in relation to the embodiment of FIG. 1 in this respect also apply to the embodiments shown in FIGS. 4, 5 and 6.

Figure 11:
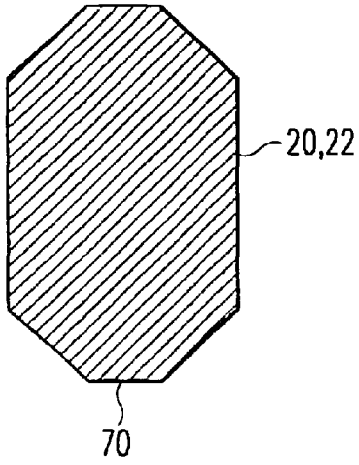
Figure 12:
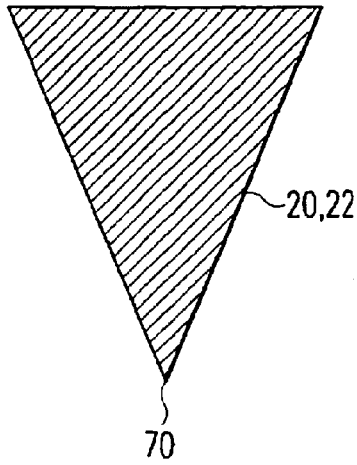

FIGS. 10 through 14 show a series of alternative embodiments of a dipole portion 20 or 22 for use in the dipole elements 16. A feeding point of the dipole portion 20, 22 where it is attached to the feeding network 18 is designated by 70 in FIGS. 10 through 14. The dipole portion 20, 22 has at least three corners, and its feeding point 70 is situated at one of the corners (as shown in FIGS. 12 to 14) or at a short edge between two closely adjacent corners (as shown in FIGS. 10 and 11). In FIG. 10, the dipole portion 20, 22 has six corners, in FIG. 11 eight corners, in FIG. 129 three corners, in FIG. 13 four corners, and in FIG. 14 five corners. Further details on the dipole portion 20, 22 can be taken from U.S. Pat. No. 6,037,911, again.

In FIGS. 15 and 16, exemplary antenna diagrams obtained by simulation are shown. The antenna diagram of FIG. 15 was obtained in a horizontal plane (azimuth), and the antenna diagram of FIG. 16 was obtained in a vertical plane (elevation). It has been shown that the antenna device according to the present invention can exhibit antenna patterns in azimuth and elevation which are approximately stable over the whole frequency range of interest.

The measured SWR diagram of FIG. 17 shows that the antenna device acording to the present invention can have an operation bandwidth (reflexion factor $S_{11}<2$) better than 37% which can be further extended.

FIG. 18 shows a 3D simulation of an antenna device according to the present invention used for a simulation, the results of which are shown in FIGS. 19 to 24. The simulated antenna device shown in FIG. 18 is similar to the embodiment shown in FIGS. 5 and 6 and comprises a cylindrical reflector 104 and four sets of respectively four dipole elements 106, each set of dipole elements 106 being arranged in an angle of 90° to its adjacent sets of dipole elements. For faster calculation and simpler modeling reasons the substrate thickness of the simulated antenna device was considered to be zero, which should not significantly influence the performance, but should lead to an increase of the loss.

As becomes clear from the simulation results of FIGS. 19 to 24, the gain is approximately stable in the entire frequency range of interest. FIGS. 19 and 20 show simulation results for the antenna device shown in FIG. 18 at a center frequency of operation of 3.4 GHz, FIGS. 21 and 22 show simulation results for the antenna device shown in FIG. 18 at a center frequency of 1.5 GHz and FIGS. 23 and 24 show simulation results for the antenna device shown in FIG. 18 at a center frequency of 3.4 GHz. Hereby, FIGS. 19, 21 and 23 respectively show diagrams of the gain obtained in a horizontal plane (azimuth) and FIGS. 20, 22 and 24 show diagrams of the gain obtained in a vertical plane (elevation). As can be seen, the antenna device according to the present invention can exhibit antenna patterns in the azimuth and elevation which are approximately stable over the whole frequency range of interest which leads to an operation bandwidth of around 80% of the center frequency of operation.

In the application scenario illustrated in FIGS. 25 and 26, the antenna device according to the present invention is integrated into a public outdoor wireless access point (POWAP) 110 mounted on a wall 108. An expected radiation pattern for the POWAP 110 in microwave and mm-wave range is indicated by 112. A similar radiation pattern would be expected in case of an RF based door opener.

FIG. 27 shows a monitoring system for monitoring a sports field 116. The monitoring system comprises a plurality of wireless cameras disposed around the sports field 116; for example, the cameras comprise several stationary cameras 118 and a moving camera 120. The video signals transmitted from the cameras 118, 120 are received by a receiving station 122 situated midway a long side of the sports field 116. The operation field of the receiving station 122 has to cover all of the cameras 118, 120 as indicated by a dashed arrow 124. This can be performed by using in the receiving station 122 an antenna device according to the present invention having a 180 degrees radiation pattern.

FIGS. 28 and 29 illustrate use of the antenna device according to the present invention in an anticollision and guidance radar system for a vehicle 126. In such a radar system, it is desired to completely observe the environment to the front and the sides of the car. To this purpose, car sensors each equipped with an antenna device according to the present invention can be mounted on the car at the sides and the front thereof. Dashed lines 128, 130, 132 show expected coverage areas for the car sensors in mm-wave range.

The antenna device according to the present invention has a high gain and a very large bandwidth and allows applications in communication systems working in the microwave or millimeter wave frequency range. A big advantage of the antenna device according to the present invention is the possibility to use the same antenna for different kinds of communication systems even at different frequency bands of interest. Possible identified mass market applications are e.g. broadband home networks, wireless LANs, private short radio links, automotive millimeter wave radars, microwave radio and TV distribution systems (transmitters and ultra low cost receivers). Some of the identified frequency bands of interest are: 2,4–2,7 GHz, 5–6 GHz, 10,5 GHz, 17–19 GHz, 24 GHz, 28 GHz, 40–42 GHz, 59–64 GHz, 76 GHz and 94 GHz. At the same time, the antenna device according to the present invention can satisfy the following general requirements made on mass market antennas: very low production costs, e.g. due to utilization of a simple planar technology, utilization of a printed technology and/or simple and cheap photolithographic processing of the prints; high reproducibility due to a low tolerance sensitivity; and simple integration with planar RF-assemblies. Furthermore, the antenna device according to the present invention features a specified radiation pattern, good matching in the frequency band of interest and a good efficiency in the frequency band of interest.

What is claimed is:

1. Antenna device, comprising:

a dielectric substrate board (10), dipole means (16) formed on said substrate board (10), and reflector means (70, 72) having first and second reflective surfaces (50, 52) which are aparallel to each other, define a first angle ($\alpha$) between each other and are formed on a single reflector member (70, 72), whereby a positional relationship between said substrate board (10) and said reflector means (70, 72) is such that said substrate board (10) and a vertex of said first angle ($\acute{a}$) substantially lie in a same plane (M) and said first and second reflective surfaces (50, 52) lie on opposite sides of said plane (M), a second angle ($\beta$) defined between said substrate board (10) and said first reflective surface and a third angle (γ) defined between said substrate board (10) and said second reflective surface being different from zero each; said reflector member having a slot (60) substantially at said vertex, with said substrate board (10) extending through said slot.

2. Antenna device according to claim 1, characterized in that said second and third angles (β, γ) are equal to each other.

3. Antenna device according to claim 1, characterized in that said second and third angles (β, γ) are different from each other.

4. Antenna device according to claim 1, characterized in that said second and third angles (β, γ) range from 10 degrees to 170 degrees each.

5. Antenna device according to claim 1, characterized in that said first and second reflective surfaces (50, 52) are plane surfaces.

6. Antenna device according to claim 1, characterized in that said first and second reflective surfaces are curved surfaces.

7. Antenna device according to claim 1, characterized in that said reflector member (48) is made from a plate member which is bent essentially into a V shape having a fold line (54) at said vertex of said first angle (α).

8. Antenna device according to claim 1, characterized in that the width of said slot (60) substantially corresponds to the thickness of said substrate board (10).

9. Antenna device according to claim 1, characterized in that said reflector means (48) is forming the support of said antenna device.

10. Group of antenna devices according to claim 1, wherein each antenna device of said group differs from every other antenna device of said group in at least one of said first angle (α) and the ratio of said second angle (β) to said third angle (γ).

11. Group of antenna devices according to claim 1, wherein all antenna devices are identical.

12. Antenna device according to claim 1, characterized in that metal strip means for supplying signals to and from said dipole means (16) are formed on said substrate board (10), said metal strip means comprising at least one strip segment (62) crossing said reflector member (48), said slot (60) of said reflector member (48) having an enlarged slot portion (64) where said strip segment (62) crosses said reflector member (48).

13. Antenna device according to claim 12, characterized in that said enlarged slot portion (64) has a rounded contour.

14. Antenna device according to claim 12, characterized in that said dipole means (16) comprise at least one dipole element (16) having first and second dipole portions (20, 22) for radiating and receiving electromagnetic signals, said first dipole portion (20) being formed on a first board face (12) of said substrate board (10) and said second dipole portion (22) being formed on a second board face (14) of said substrate board (10) opposite to said first board face (12), said metal strip means comprising at least one strip segment (62) crossing said reflector member (48) on each of said first and second board faces (12, 14), said slot (60) of said reflector member (48) having an enlarged slot portion (64) in allocation to each strip segment (62).

15. Antenna device according to claim 1, characterized in that said reflector member (70, 72) forms a closed ring in its cross-section.

16. Antenna device according to claim 15, characterized in that said closed ring has a circular shape.

17. Antenna device according to claim 15, characteiized in that said closed ring has an elliptic shape.

18. Antenna device according to claim 15, characterized in that said closed ring has a rectangular shape.

19. Antenna device according to claim 15, characterized in that said dipole means (16) are arranged outside of said reflector means, whereby first dipole means are located outside a first vertex and second dipole means are located outside a second vertex.

20. Antenna device according to claim 19, characterized in that said first and second dipole means (16) are located outside respective opposite side of the reflector means, whereby third and fourth dipole means are located outside said reflector means in a plane perpendicular to the plane of the first and second dipole means.

21. Antenna device according to clain 19, characterized in that said dipole means (16) are arranged in a distance between 0.1 and 0.4λ from the reflector means, λ being the wavelength of the center frequency of operation of the antenna device.

22. Antenna device according to claim 21, characterized in that said dipole means (16) are arranged in a distance of 0.25λ from the reflector means.

* * * * *